United States Patent [19]

Yamanouchi et al.

[11] Patent Number: 4,735,413

[45] Date of Patent: Apr. 5, 1988

[54] TENNIS PRACTICE APPARATUS

[76] Inventors: Tatsuo Yamanouchi; Mutsumi Yoshida, both of c/o Kabushiki Kaisha Gakushu Kenkyusha, 40-5, Kamiikedai 4-chome, Ohta-ku, Tokyo, Japan

[21] Appl. No.: 770,771

[22] Filed: Aug. 28, 1985

[30] Foreign Application Priority Data

Aug. 28, 1984 [JP] Japan ..... 59-130354[U]
Jan. 25, 1985 [JP] Japan ..... 60-9429[U]

[51] Int. Cl.[4] ..... A63B 69/40

[52] U.S. Cl. ..... 273/29 A; 273/26 E; 273/413; 273/58 C

[58] Field of Search ..... 273/26 E, 29 A, 58 C, 273/26 EA, 413, 414, 200 R, 200 A, 184 B, 185 C, 330; 272/77, 78, 76

[56] References Cited

U.S. PATENT DOCUMENTS

| | | | |
|---|---|---|---|
| 831,605 | 9/1906 | Doyle | 273/26 E |
| 1,554,409 | 9/1925 | Coffee | 273/26 E |
| 2,247,072 | 6/1941 | Stow | 273/29 A |
| 3,475,026 | 10/1969 | Cooper | 273/26 E |
| 3,477,717 | 11/1969 | Clark | 273/587 |
| 4,113,257 | 9/1978 | Moffatt | 273/587 |

FOREIGN PATENT DOCUMENTS

| | | | |
|---|---|---|---|
| 48-50168 | 6/1973 | Japan . | |
| 51-88333 | 7/1975 | Japan . | |
| 53-38458 | 4/1978 | Japan . | |
| 53-56267 | 5/1978 | Japan . | |
| 54-64572 | 5/1979 | Japan . | |
| 54-126764 | 9/1979 | Japan . | |
| 57-45971 | 3/1982 | Japan . | |
| 57-67770 | 4/1982 | Japan . | |
| 11097 | of 1903 | United Kingdom | 272/77 |

*Primary Examiner*—Richard C. Pinkham
*Assistant Examiner*—T. Brown
*Attorney, Agent, or Firm*—Lowe, Price, LeBlanc, Becker & Shur

[57] ABSTRACT

A tennis practice apparatus including a ball secured to a string. The apparatus (1) is essentially composed of a plurality of string members (3), (5), a plurality of fastening members (11), (12), (13) for the string members, and a frame body (2) which is provided with the fastening members at first and second positions in the same plane and at a third position which is above those two positions. The three positions to which the fastening members are attached constitute the vertices of a triangle formed in a plane substantially perpendicular to the base portion of the frame body. The string members have a guide rope (3) stretched between the fastening members (12), (13) at the first and second positions, and an elastic string (5) which freely extends or contracts with one end secured to the fastening member (11) at the third position and the other end slidably secured to the guide rope. At least one, or, if necessary, two balls (4) are attached at the intermediate portion of the elastic string (5).

24 Claims, 10 Drawing Sheets

TENNIS PRACTICE APPARATUS

BACKGROUND OF THE INVENTION

This invention relates to a tennis practice apparatus for practicing tennis strokes and the like by hitting a ball provided on a string member.

SUMMARY OF THE INVENTION

It is an object of the invention to provide a tennis practice apparatus which gives a player the feeling of actual stroke play, enables sufficient practice of follow-through, is compact and has good durability.

To achieve this aim, this invention provides a tennis practice apparatus comprising: a plurality of string members; at least three fastening members to which are fitted the end portions of the string members; a frame body having the fastening members secured at predetermined positions, these predetermined positions having first and second positions which are situated in the same plane, and a third position which is situated in a plane above the first and second positions, the three positions constituting the three vertices of a triangle which is formed on a surface substantially perpendicular relative to a base plate; the string members including a first guide rope stretched between the fastening members provided at the first position and the second position, and a first elastic string which freely extends or contracts with one end attached to the fastening member which is provided at the third position and the other end slidably secured to the first guide rope; and at least one ball which is secured at an intermediate portion of the first elastic string.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
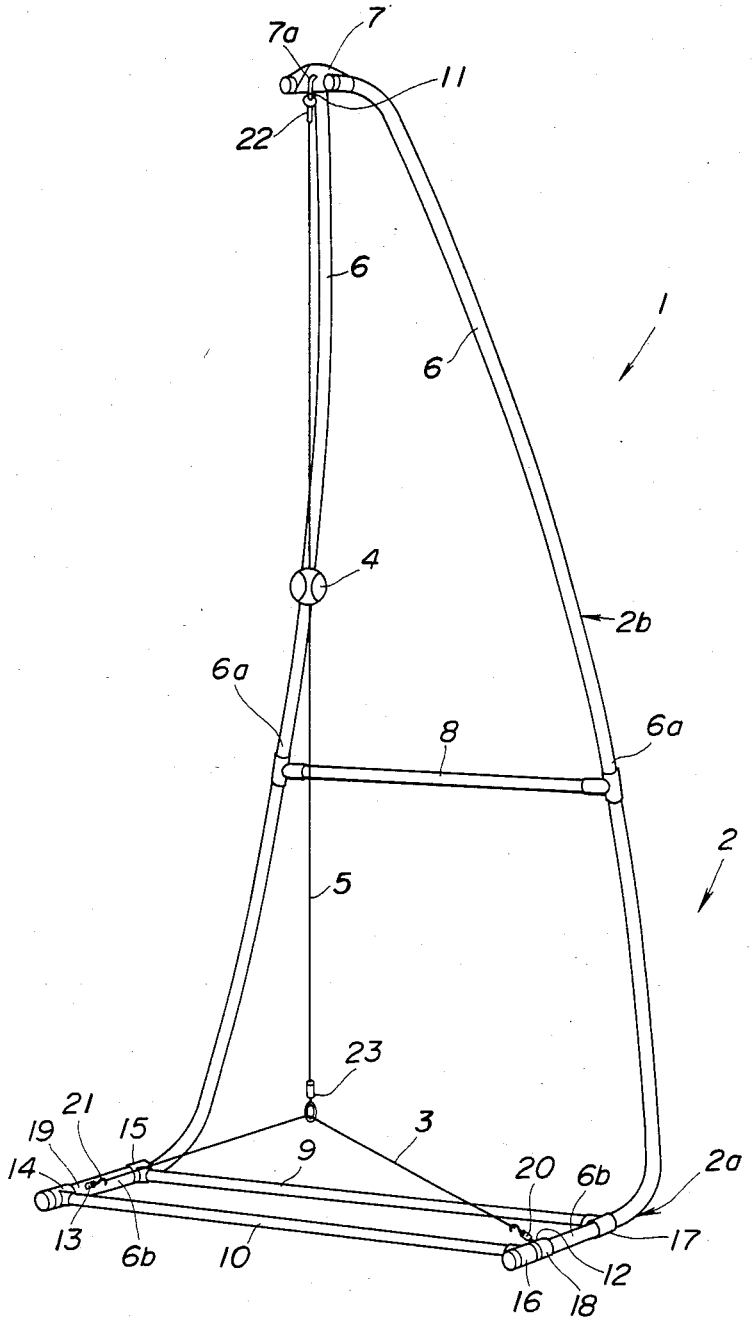
FIG. 1 is a perspective view of the entire body of an embodiment of a tennis practice apparatus according to the invention.
Figure 2:
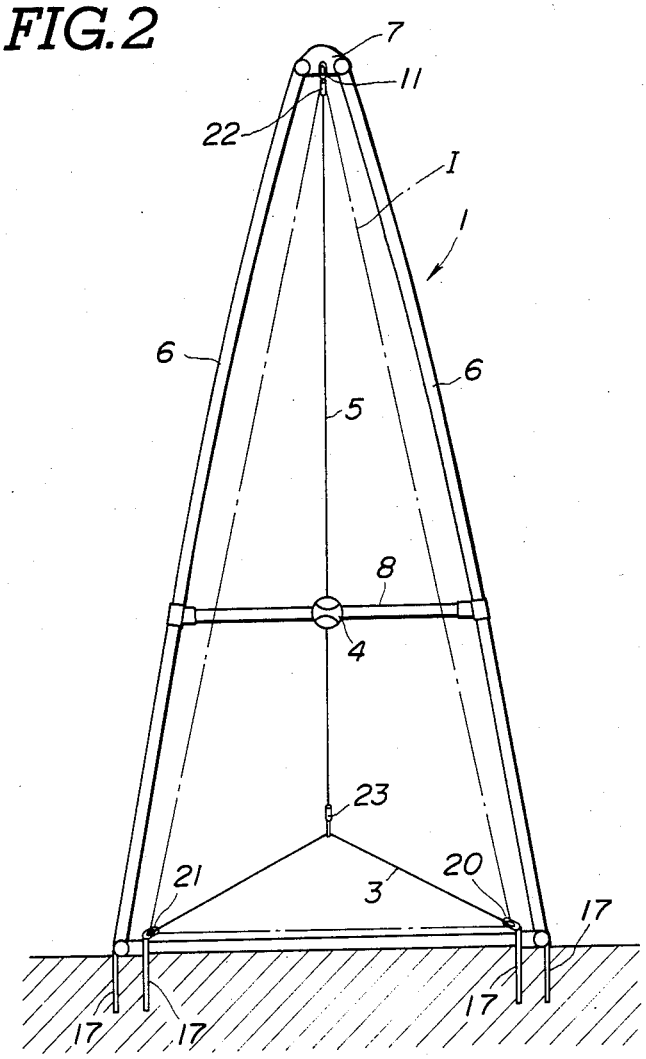
FIG. 2 is an elevational view of the embodiment.
Figure 3:
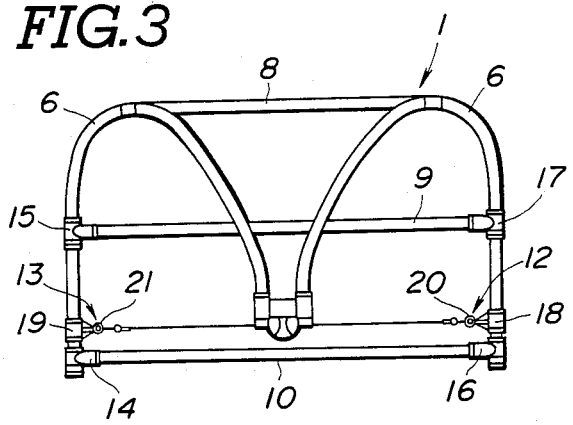
FIG. 3 is a plan view of the embodiment.

Referring first to FIGS. 1 to 3, a tennis practice apparatus (1) is composed of a support frame body (2), a guide rope (3), and an elastic string member (5) which is inserted through the center of a tennis ball (4). The support frame body (2) is composed of a pair of pipes (6), (6) which are fixed at their upper portions by a connecting member (7), the upper portions being brought into close proximity with each other, and cross members (8), (9), and (10), the first (8) of which is provided between the intermediate points (6*a*), (6*a*) where the upward curve of the pipe (6) begins and the others (9), and (10) between the horizontal portions (6*b*), (6*b*), respectively. The arrangement is such that the width between the vertical pipes (6), (6) gradually gets larger toward the base, the configuration viewed from the front is substantially in the form of a triangle, and the side elevational configuration is substantially in the form of a bow. The horizontal portions (6*b*), (6*b*) and the cross members (9) (10) of the pipes (6) (6) constitute a base frame portion (2*a*) which supports the entire body of the support frame body (2), and the intermediate portions (6*a*) (6*a*) and the cross member (8) constitute a supporting portion (2*b*). A fastening member (11) for the elastic string member (5) is provided on the connecting member (7) at the upper end of the frame body (2) and fastening members (12), (13) for the guide rope (3) are provided on the opposing horizontal pipes (6*b*) (6*b*), respectively, of the base frame portion (2*a*). In other words, these fastening members are provided at the positions which correspond to the respective verteces of an erect isosceles triangle (I) in front view, as is shown in FIG. 2. The support frame body (2) is installed by driving into the ground fixing stays (29) shown in FIG. 2 which are attached to connecting members (14) (15) (16) and (17) for securing both ends of the cross members (9) and (10) to the pipes (6) (6).

The guide rope (3) is fitted to the fastening members (12) and (13) in parallel to the cross members (9) and (10). Each of the fastening members (12) and (13) is composed of a cylindrical body (18) or (19) which is fitted over the horizontal portion (6*b*) of the pipe (6), and a hook (20) or (21), such as to be slidable on the horizontal portion (6*b*) which is orthogonal to the cross members (9) and (10).

The elastic string member (5) is composed of a rubber core (27) and a woven fiber string (28) which envelops the rubber core (27) and is inserted through the tennis ball (4), thereby supporting the tennis ball in such a manner that it may move. One end of the elastic string member (5) is fitted to the fastening member (11) through a tension controlling member (22) and the other end is slidably fitted to the guide rope (3) by means of a ring member (23). Two balls (4) provided at a predetermined distance form each other may be fitted to the elastic string member (5) such as to have different heights from the base frame portion (2*a*), as is shown in FIG. 4.

Figure 4:
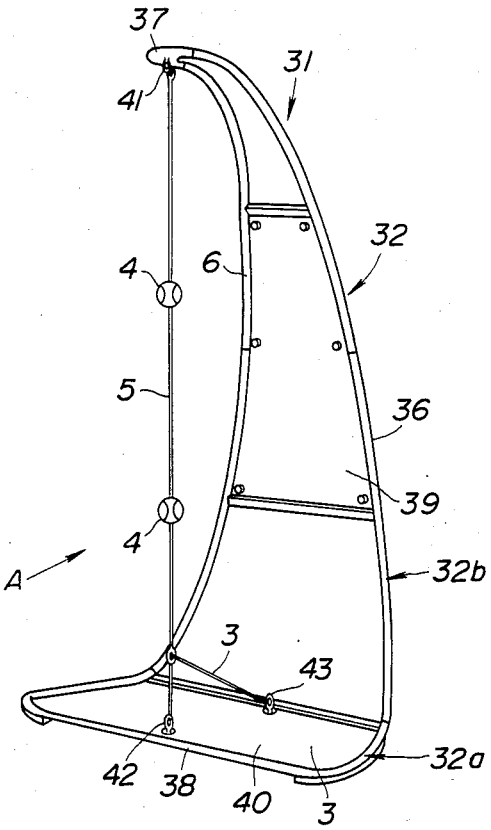
FIG. 4 is a perspective view of the entire body of a second embodiment of a tennis practive apparatus according to the invention.
Figure 5:
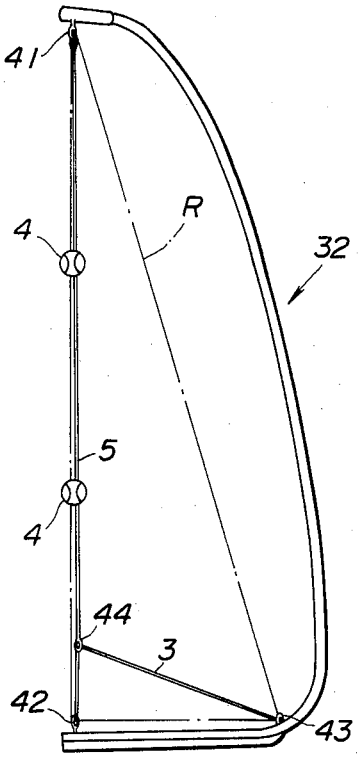
FIG. 5 is a side elevational view of the embodiment shown in FIG. 4.

FIGS. 4 and 5 show a second embodiment of the invention. A support frame body (32) of a tennis practice apparatus (31) is, as is the case with the above-described embodiment, composed of a base frame portion (32*a*) incorporating a pipe (38) which extends substantially horizontally, and a supporting portion (32*b*) incorporating a pair of pipes (36) (36) which extend upwardly from the base frame portion (32*a*) and are connected by a connecting member (37) at the upper portions of the pipes with the upper portions brought into close proximity with each other. A base plate (40) is mounted on the base frame portion (32*a*) and a trapezoidal reinforcing plate (39) is inserted between the pipes (36), (36).

In the central portion of the front and rear ends, respectively, of the base plate (40) of the base frame portion (32*a*) are provided fastening members (42) (43) for the guide rope (3), and a fastening member (41) for the elastic string member (5) is provided on the connecting member (37) at the upper end of the supporting portion (32*b*). These fastening members (41), (42) and (43) are provided at the positions which correspond to the respective vertices of a substantially right angled triangle (R) as viewed in elevation from the side of the frame body (32) shown in FIG. 5.

A ring member (44) is slidably attached to the guide rope (3), and an elastic string (5) which passes through and supports the ball (4) is stretched between the ring member (44) and the fastening member (41) on the connecting member (37).

Though in the first and second embodiments described above, the triangle which is defined by lines connecting the fastening members for the string member which are provided at three positions is referred to as an isosceles or right angled triangle, it is not limited to these configurations.

Various examples of a method of securing the ball (4) to a string member (4) will be explained in the following.

Figure 6:
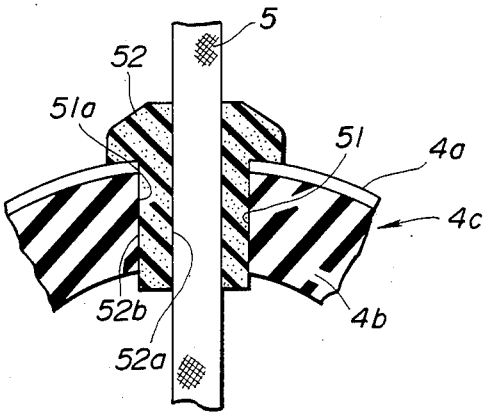
FIG. 6 is an enlarged partially sectional view of a ball and a string member showing an example of a method of securing a ball to a string member.

The hollow spherical body (4*c*) of the ball (4) which is shown in an enlarged state in FIG. 6 is composed of a felt portion (4*a*) and a hard rubber portion (4*b*). A bushing (52) is inserted into an aperture (51) which is provided on a line passing through the center of the spherical body (4*c*), and the elastic string (5) is inserted into a through hole (52*a*) provided in the bushing (52) in its axial direction. The bushing (52) is formed of soft rubber having a smaller elasticity modulus than the hard rubber portion (4*b*) of the spherical body (4*c*). The through hole (52*a*) of the bushing (52) has an inner diameter smaller than the outer diameter of the elastic string member (5), and the inner peripheral surface of the through hole (52*a*) presses against the outer periphery of the elastic string member (5). The outer peripheral surface (52*b*) of the bushing (52) is fixed to the inner surface (51*a*) of the sperture (51) of the ball (4) by an adhesive or the like. The position of the ball (4) is controlled by the sliding action of the ball in resistance to the resisting force produced between the through hole (52*a*) of the bushing (52) and the string member (5).

Figure 7:
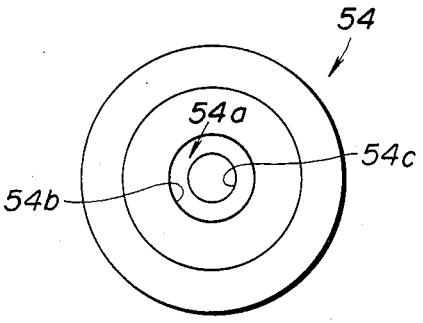
FIGS. 7A, 8, and 9 are respectively plan views of modifications of the bushing of the example shown in FIG. 6.
FIG. 7B is a vertical sectional view of the bushing shown in FIG. 7A.
Figure 7:
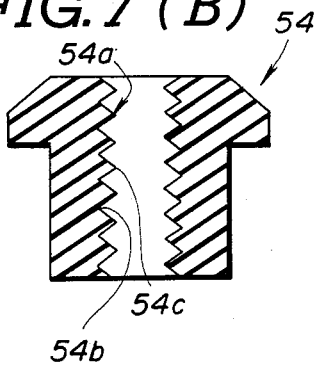
Figure 8:
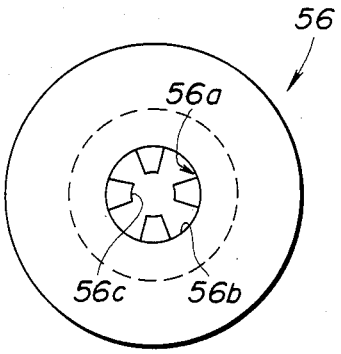
Figure 9:
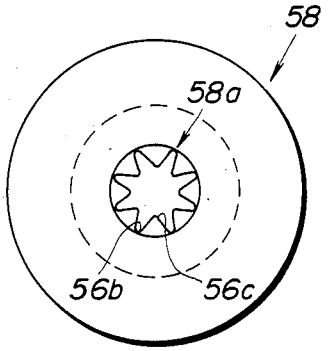

FIGS. 7, 8 and 9, respectively, show modifications of the bushing. FIGS. 7A and 7B show an example in which screw-shaped ridges (54*c*) and valleys (54*b*) are cut on the inner peripheral surface of a through hole (54*a*) of a bushing (54). FIG. 8 shows an example in which substantially rectangular ridges (56*c*) and valleys (56*b*) are provided alternately in the circumferential direction on the inner peripheral surface of a through hole (56*a*) of a bushing (56). FIG. 9 shows an example in which V-shaped valleys (58*b*) and triangular ridges (58*c*) are provided alternately in the circumferential direction on the inner peripheral surface of a through hole (58*a*) of a bushing (58).

Figure 10:
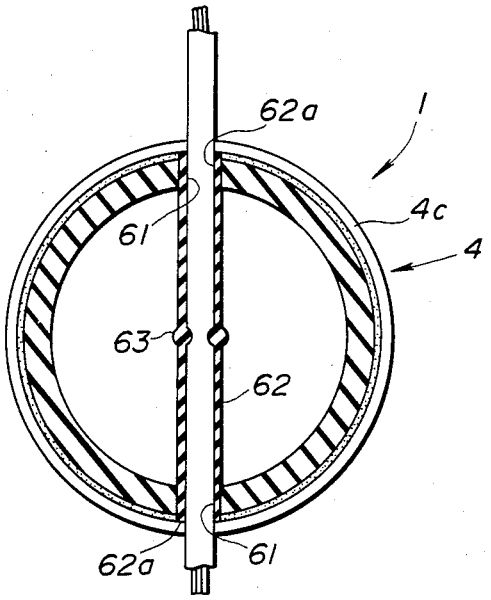
FIGS. 10, 11 and 12 are, respectively, vertical sectional views of other examples of methods of securing the ball to a string member and their modifications.
Figure 11:
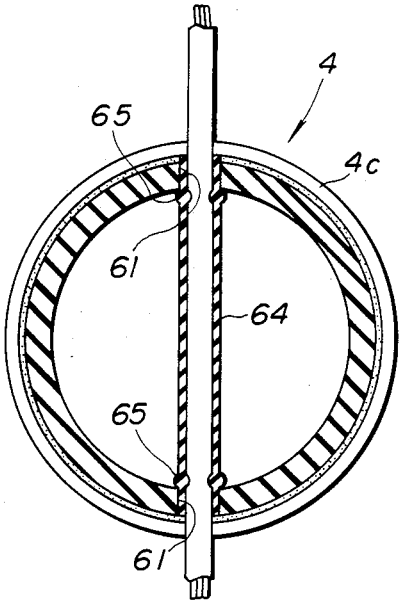
Figure 12:
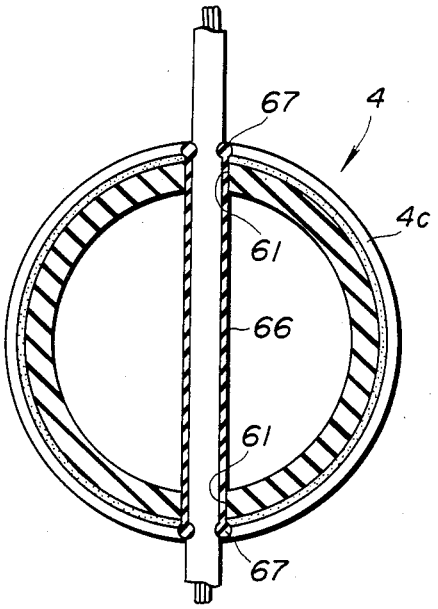

FIGS. 10, 11, and 12 show examples in each of which a rubber tube is used in place of the bushing. In each of these figures, a rubber tube (62) is extended between two apertures (61), (61) which are provided at diametrically opposite positions on the periphery of the spherical body (4*c*) of the ball (4) and both ends of the tube (62) are secured to the apertures (61) (61). The elastic string (5) passes through the rubber tube (62). In FIG. 10, a small diameter portion (63) is formed at a substantially central part of the rubber tube (62), such as to press against and retain the elastic string (5) inserted in the tube (62) with an especially strong elastic force. FIGS. 11 and 12 show examples in which a small diameter portion (65) of a rubber tube (64) and a small diameter portion (67) of a rubber tube (66) are provided in the vicinity of the inner ends and outer ends, respectively, of the apertures (61) (61) of the spherical body (4*c*).

Figure 13:
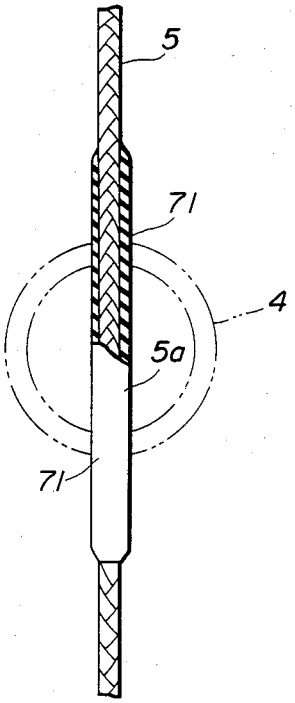
FIG. 13 is a partially cutaway side elevational view of a ball securing portion of an elastic string which illustrates still another example of the invention.

FIG. 13 shows an example in which the entire periphery of a ball securing portion (5*a*) of the elastic string (5) is enveloped by rubber extending over a predetermined length. The outer diameter of the ball securing portion (5*a*) which is enveloped by the rubber is made larger than the inner diameter of an aperture (71) of the ball (4), whereby the mounting portion (5*a*) of the string (5) is pressed against the aperture (71) of the ball (4) by virtue of the elastic force of the rubber enveloping the mounting portion (5*a*).

Figure 14:
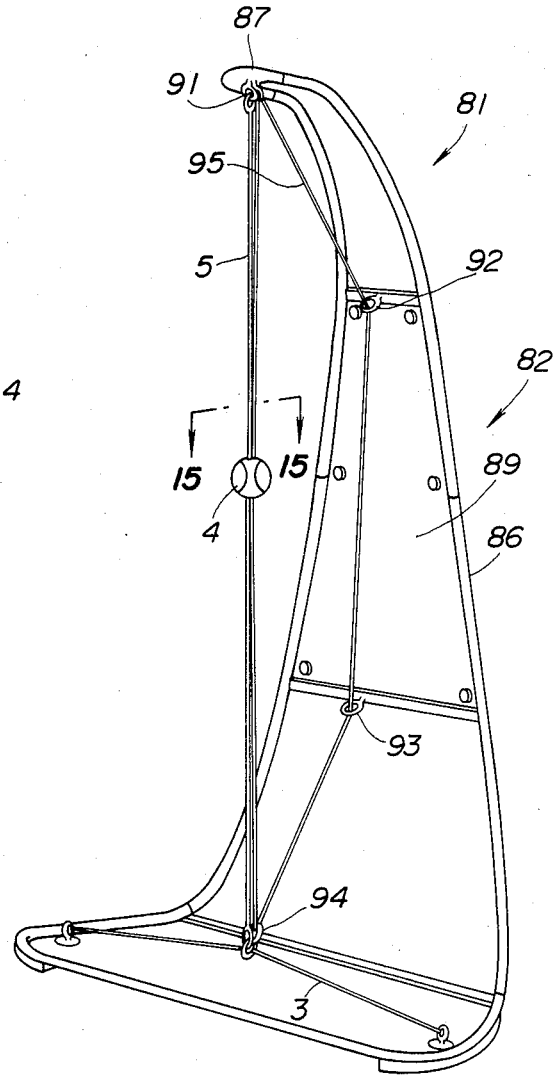
FIG. 14 is a perspective view of the entire body of a tennis practice apparatus showing a further example of the invention.
Figure 15:
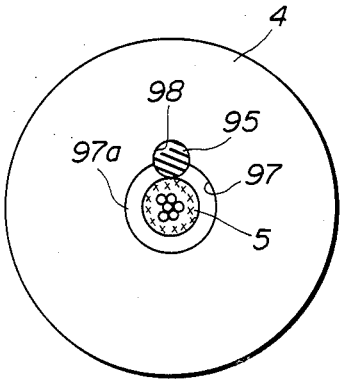
FIG. 15 is a sectional view of the elastic string shown in FIG. 14 taken along the line 15—15.

FIGS. 14 and 15 show another example in which the ball (4) is supported by using a second elastic string (95) which is stretched in parallel to the elastic string (5). The practice apparatus (81) shown in FIG. 14 is fundamentally the same as the appratuses (1) and (31) shown in FIGS. 1 and 4. It is different from those apparatuses in that ringlike guide members (92) and (93) are provided in the central part of the upper and lower ends of a reinforcing plate (89), and in that the second string member (95) which passes through and is secured to the ball (4) is passed through a fastening member at the upper end of a supporting portion (82*b*), the guide members (92) and (93) and a ring member (94) on the guide rope (3), successively, such as to assume the form of a loop, whereby the ball (4) is supported at a vertically appropriate position between the support frame body (82).

The first string member (5) is inserted through the ball (4) i such a manner that the ball (4) is freely movable with respect to it. As is clear from FIG. 15, the outer diameter of an aperture (97) for passing through the string member (5) is made larger than the outer diameter of the string member (5) and a gap (97*a*) is formed between the string member (5) and the aperture (97), whereby the ball (4) is made slidable in relation to the string member (5).

The second string member (95) is formed of a soft rubber material, and its diameter is smaller than that of the first string member (5). The second string member (95) is inserted through a second aperture (98) which is provided at the side portion of the first aperture (97) such that they partially overlap each other and such that the second string member (95) is movable in relation to the first string member (5), being secured to the inner peripheral portion of the aperture (97) by an adhesive or the like. The ball (4) is supported by the second string member (95). The use of the second string member (95) in this example facilitates control of the height of the ball (4).

Figure 16:
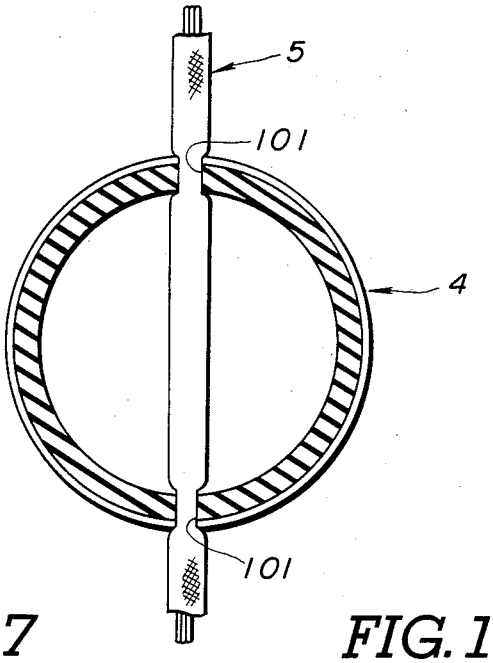
FIG. 16 is a vertical sectional view of a ball with the elastic string inserted therethrough which illustrates a still further example of the invention.
Figure 17:
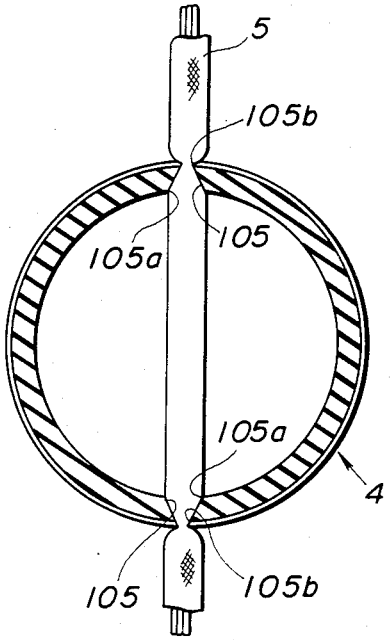
FIGS. 17 and 18 show modifications of the example shown in FIG. 17.

FIGS. 16 and 17 show an example in which the ball (4) is attached directly to the elastic string member (5). In FIG. 16, the bore of an aperture (101) of the ball (4) is made smaller than the outer diameter of the string member (5), and the ball (4) is supported at an appropriate position by the string member (5) because the entire inner peripheral surface of the aperture (101) of the hard rubber portion (4*b*) of the ball (4) presses against the outer periphery of the string member (5) which is inserted through the aperture (101).

Figure 18:
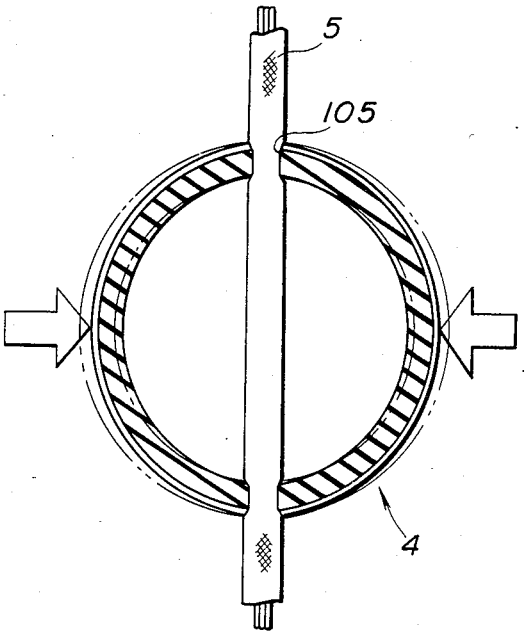

In FIG. 17 a through hole (105) of the ball (4) is so formed as to taper in such manner that the inner diameter of its inner end portions is made substantially the same as the outer diameter of the string member (5) and the inner diameter of the outer end portions (105*b*) is made smaller than the outer diameter of the string member (5), whereby the small diameter portion of the outer end portions (105*b*) presses against the outer periphery of the string member (5). In this case, changes in the position of the ball (4) are facilitated by lightly pressing the central portion of the ball (4) as is indicated by the arrows in FIG. 18 and thereby enlarging the small diameter portions (105*b*).

FIGS. 19 to 22 show an improved tennis practice apparatus which enables practice of serving as well as of stroke play.

Figure 19:
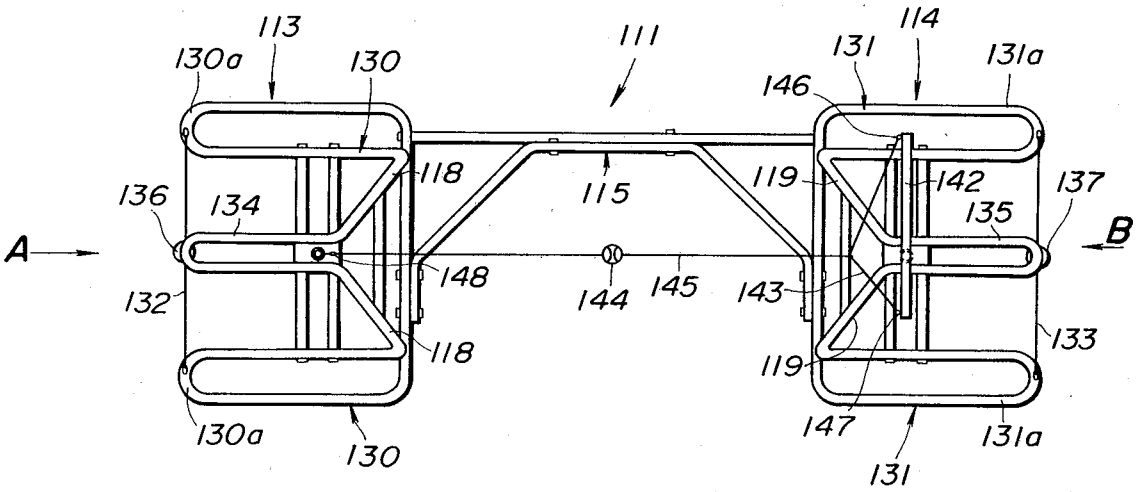
FIG. 19 is a plan view of a still further embodiment of a tennis practice apparatus according to the invention which enables serving practice.
Figure 20:
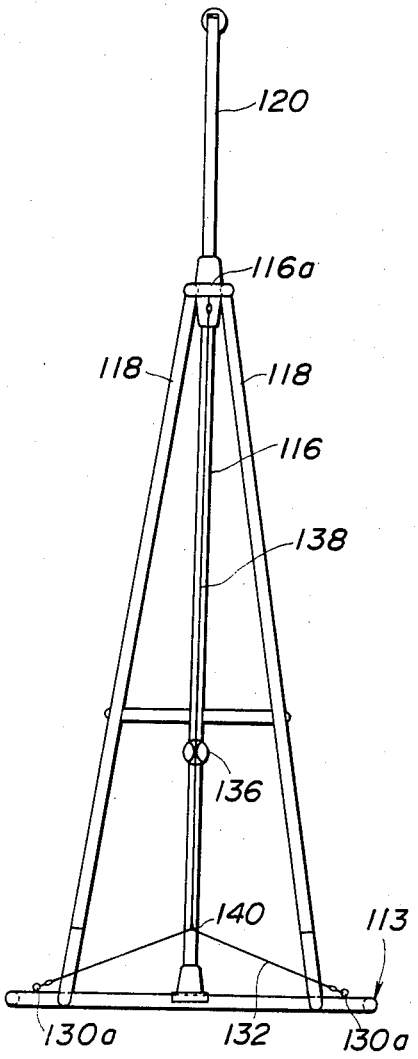
FIGS. 20 and 21 are elevational views of a first support frame body and a second support frame body, respectively, constituting the apparatus shown in FIG. 19.
Figure 21:
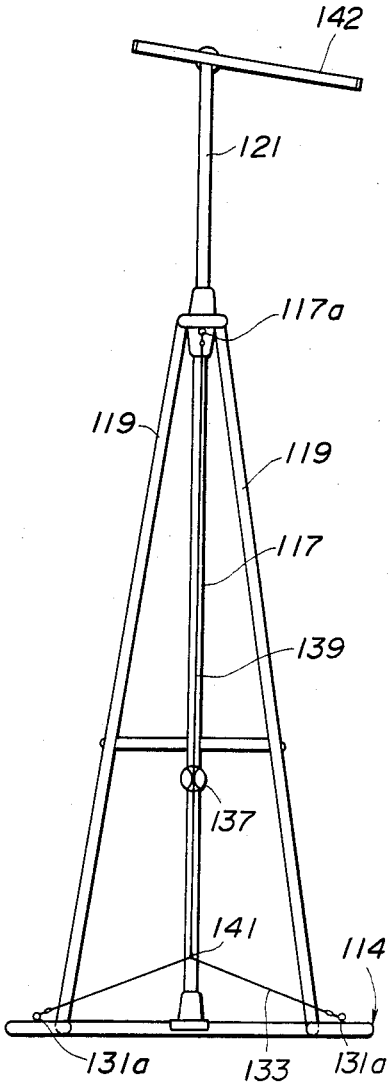

Referring to FIGS. 19 to 21, a tennis practice apparatus (111) is composed of first and second support frame bodies (113) and (114) which are provided such as to face away from each other and a connecting portion (115) for connecting these frame bodies. All three are formed of pipe members. Supports (116) and (117) are provided at a substantially central portion of the support frame bodies (113) and (114) such as to extend downwardly, while at the upper positions above the upper end portions (116*a*) and (117*a*), upwardly extending portions (120) and (121) are provided such as to be vertically movable in relation to the supports (116) and (117). The supports (116) and (117) are supported by support pipes (118) and (119) disposed at the rear and on the right and left sides, while base frame portions (130) and (131) of the apparatus (111) are formed as a base below those members (116), (117), (118) and (119). At the front ends of both of the base frame portions (130) and (131) on each side thereof are provided fastening members (130*a*) and (131*a*) for guide ropes (132) and (133), respectively, these being employed for stroke play. Extending portions (134) and (135) are provided at the upper ends of the supports (116) and (117) which extend forwardly of the respective frame bodies (113) and (114), and fastening members (134*a*) and (135*a*) for fixing one end of both string members (138), (139) with the respective balls (136) and (137) attached thereto are fixed to the forward ends of the extending portions (134) and (135). The other ends of the string members (138) and (139) are slidably attached to the guide ropes (132) and (133) through ring members (140) and (141). The balls provided in this manner are used for practicing strokes.

At an upper end of one (121) of the upwardly extending portions (120) and (121) is provided an indicator rod (142) for indicating the direction for serving. This indicator rod inclines downward and forward of the apparatus and extends transversely thereof. Fastening members (146) and (147) at each end of a guide rope (143) are secured to each end of the rod (142).

One end of a string member (145) with a ball (144) provided at a substantially central portion thereof is slidably attached to the guide rope (143) and the other end is horizontally attached to a string member fastening member (148) provided at the upper end portion of the other upward extending portion (120). The ball (144) provided in this manner is used for serving practice. The fastening members (146), (147) and (148) are at higher positions than the fastening members (134*a*) and (135*a*) for string members (138) and (139) which are used for practicing stroke.

Figure 22:
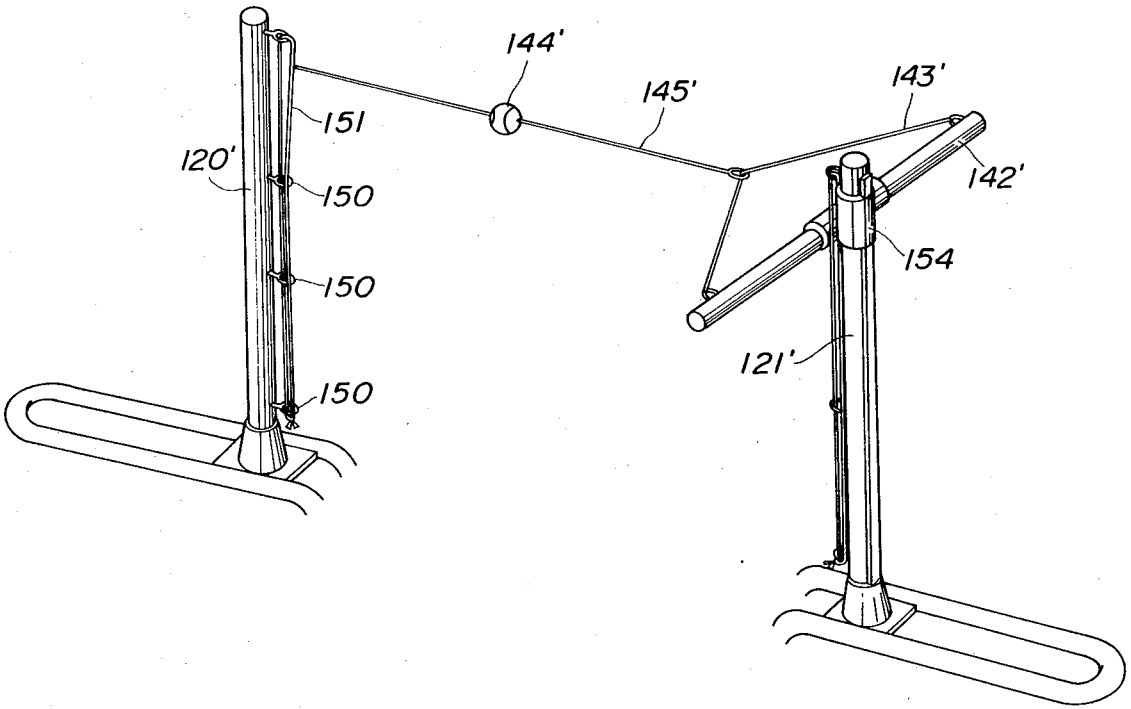
FIG. 22 is a partially enlarged perspective view of the first and second support frame bodies showing a modification of the upwardly extending portions of the supports.

In FIG. 22, upwardly extending portions (120') and (121') provided at the upper end portions of the frame bodies (113) and (114) are secured to the supports (116) and (117), and a serve direction indication rod (142') is attached to a member which is provided on one (121') of the upwardly extending portions in such a manner as to be longitudinally slidable. To the other upwardly extending portion (120') is attached a loop string (151) for controlling the height through a plurality of rings (150), and a string member (145') with a ball (144') for practicing serves attached thereto is supported between a guide rope (143') on the rod (142') and the loop string (151) in such a manner that the height is freely controllable.

As is obvious from the above explanation, this invention brings about the following advantages.

Firstly, since a support frame body is constructed of pipe members in such a manner as to have a substantially triangular configuration as viewed from the front and has a trussed structure, the structure is very rigid, and vibration is absorbed by the frame body such that stress is diffused, resulting in a stable, small and light device. Therefore, it is easy to set up the apparatus irrespective of the conditions of the chosen location, for example it does not matter whether the site is on a concrete surface or a dirt surface.

Secondly, since the string member with a ball provided thereon is slidably attached to a guide rope, and both ends of the guide rope are also slidably fitted to the fitting portion of the frame body, the amount of resistive force apart from the repulsive force produced at the moment the ball is hit is minimized. In addition, since a racket is never caught in the string members, it is easy to swing the racket freely, and sufficient practice of follow-through is thus enabled. Furthermore, the durability of the string members is improved, because the inertia force of the ball is dispersed uniformly through the string member upwardly and downwardly of the ball.

Thirdly, the string member is composed of a rubber core and a woven fiber string. The synthetic properties of both material absorb the inertia of the ball when hit, thereby weakening the inertia of the ball, while the properties of the woven fiber string restrain the ball from hurtling farther than necessary. As a result, it is easy to practice stroke play continuously.

Fourthly, since the position (height) of the ball is freely changeable, practice is possible in a similar manner for children and adults, irrespective of age or physique. In addition, the tension controlling member of the string member can vary the tension of the string member, and hence vary the behavior of the ball in terms of the principle of equivalence.

Incidentally, the invention is primarily intended for use as a tennis practice apparatus, but it can be adapted for use as a practice apparatus for sports other than tennis. It can, for example, be satisfactorily used as a batting practice apparatus by attaching a baseball thereto or a boxing practice apparatus by attaching a punchball thereto.

Although there have been described what are at present considered to be the preferred embodiments of the present invention, it will be understood that the invention may be embodied in other specific forms without departing from the spirit or essential characteristics thereof. The present embodiments are therefore to be considered in all respects as illustrative and not restrictive. The scope of the invention is indicated by the appended claims rather than by the foregoing description.

What is claimed is:

1. A tennis practice apparatus comprising:

a plurality of string members;

at least three fastening members which are attached to the end portions of said string members;

a frame body having said fastening members secured at predetermined positions, said predetermined positions having first and second positions which are situated in the same plane, and a third position which is situated in a plane above said first and second positions, said three positions constituting the three vertices an erect triangle;

said string members including a first guide rope stretched between said fastening members provided at said first position and said second position, and a first elastic string which freely extends or contracts with one end attached to said fastening member which is provided at said third position and the other end slidably secured to said first guide rope; and at least one ball which is secured at an intermediate portion of said first elastic string.

2. A tennis practice apparatus according to claim 1, wherein said triangle formed by said three vertices is an isosceles triangle.

3. A tennis practice apparatus according to claim 2, wherein said fastening members provided at said first and second positions are slidable in substantially orthogonal relation to the line connecting said fastening members.

4. A tennis practice apparatus according to claim 1, wherein said triangle formed by said three vertices is a right angled triangle.

5. A tennis practice apparatus according to claim 1, wherein a second ball is attached to said first elastic string at a predetermined distance from the other ball.

6. A tennis practice apparatus according to claim 1, wherein said elastic string passes through said ball such that said ball is slidable on said first elastic string while being subjected to constant resistance.

7. A tennis practice apparatus according to claim 6, wherein said ball is composed of a hollow spherical body, two apertures provided at diametrically opposite positions on the periphery of said spherical body, and a bushing which is secured to each of said apertures and has a through hole through which said first elastic string is passed.

8. A tennis practice apparatus according to claim 7, wherein said bushing is formed of soft rubber and said through hole has a smaller inner diameter than the outer diameter of said first elastic string such that at least a part of the inner peripheral surface of said through hole presses against the outer periphery of said first elastic string.

9. A tennis practice apparatus according to claim 8, wherein said through hole of said bush has ridges and valleys formed on the inner peripheral surface thereof.

10. A tennis practice apparatus according to claim 6, wherein said ball is composed of a hollow spherical body, two apertures provided at diametrically opposite positions on the periphery of said spherical body, and an elastic tube which is extended between said apertures within said spherical body, and through which said first elastic string passes, a retaining portion for retaining the outer periphery of said elastic string being provided on a part of the inner peripheral surface of said elastic tube.

11. A tennis practice apparatus according to claim 6, wherein said ball is composed of a hollow spherical body and two apertures provided at diametrically opposite positions on the periphery of said spherical body, and a ball securing portion having a periphery, rubber enveloping the periphery and extending over a predetermined length of said first elastic string, the outer diameter of said ball securing portion being larger than the inner diameter of said apertures of said ball, and said ball securing portion pressing against said apertures of said ball.

12. A tennis practice apparatus as recited in claim 11 wherein said ball securing portion includes compressed portions engaging said apertures of said ball.

13. A tennis practice apparatus as recited in claim 12 wherein the rubber enveloping the periphery of said ball securing portion includes compressed portions having a reduced outer diameter in engagement with said apertures of said ball, said compressed portions being compressed by the diameter of said apertures of said ball.

14. A tennis practice apparatus according to claim 1, wherein said string members further include a second elastic string which is stretched in parallel to said first elastic string between said fastening member at said third position and said guide rope such as to be movable in relation to said first elastic string, said first elastic string is inserted through said ball in such a manner that said ball is slidable on said first string, and said ball is fixed to said second string.

15. A tennis practice apparatus according to claim 1, wherein said frame body is composed of a base frame portion which extends substantially horizontally and is provided with said fastening members at said first and second positions, and a supporting portion which extends upwardly from said base frame portion and has said third fastening member provided thereon at said third portion.

16. A tennis practice apparatus according to claim 15, wherein said frame body includes an extending portion which extends upwardly from said supporting portion, and said extending portion carries another fastening member at a fourth position, said fourth position being higher than said third position.

17. A tennis practice apparatus according to claim 16, wherein a rod member, extending transversely of a longitudinal axis of said extending portion, is secured to said extending portion, and said rod member has fastening members for said string member which are provided at a fifth position and a sixth position which are situated in substantially the same plane with said fourth position.

18. A tennis practice apparatus according to claim 17, wherein said string members further include a second guide rope which is stretched between said fastening members provided at said fifth and sixth positions, and a third elastic string which freely extends and contracts, which is substantially horizontally stretched with one end slidably secured to said second guide rope, and to which, in addition to said ball, at least one ball is secured.

19. A tennis practice apparatus according to claim 17, wherein said rod member is so provided as to incline downwardly.

20. A tennis practice apparatus according to claim 19, wherein said rod member is movable longitudinally of said extending portion.

21. A tennis practice apparatus according to claim 19, wherein said extending portion is movable with respect to said supporting portion.

22. A tennis practice apparatus according to claim 16, wherein said extending portion is movable with respect to said supporting portion.

23. A tennis practice apparatus as recited in claim 1, further comprising sliding means at said other end of said first elastic string for providing sliding engagement between said first elastic string and said first guide rope.

24. A tennis practice apparatus as recited in claim 23, wherein said sliding means comprises ring means connected to said other end of said first elastic string, said ring means having an opening for passage of said first guide rope therethrough, thereby constraining said other end of said first elastic string to slide along said first guide rope.

* * * * *